US007927234B2

(12) United States Patent
Aoyama

(10) Patent No.: US 7,927,234 B2
(45) Date of Patent: Apr. 19, 2011

(54) GOLF BALL DIMPLE PATTERNS WITH MULTIPLE PHYLLOTACTIC ELEMENTS

(75) Inventor: Steven Aoyama, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 115 days.

(21) Appl. No.: 12/361,573

(22) Filed: Jan. 29, 2009

(65) Prior Publication Data

US 2010/0190583 A1 Jul. 29, 2010

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS

| | | | | |
|---|---|---|---|---|
| 6,338,684 | B1 * | 1/2002 | Winfield et al. | 473/378 |
| 6,533,684 | B2 * | 3/2003 | Winfield et al. | 473/378 |
| 6,682,441 | B2 * | 1/2004 | Winfield et al. | 473/378 |
| 6,699,143 | B2 * | 3/2004 | Nardacci et al. | 473/378 |
| 6,702,696 | B1 * | 3/2004 | Nardacci | 473/383 |
| 6,884,184 | B2 * | 4/2005 | Nardacci | 473/383 |

* cited by examiner

*Primary Examiner* — Raeann Trimiew
(74) *Attorney, Agent, or Firm* — D. Michael Burns

(57) ABSTRACT

A golf ball is disclosed having a plurality of dimples on its surface, the dimples being arranged in patterns determined by the science of phyllotaxis. Phyllotactic patterns are used to ascertain the placement of dimples in each polygonal face of a polyhedron based dimple pattern. Phyllotactic patterns provide for the arrangement of multiple spiral shaped strings of dimples within individual polygonal faces of a golf ball surface, with each polygonal face area having its own phyllotactic origination point at its center. The resulting multiple axes of symmetry in the overall dimple pattern provide improved symmetry of flight performance.

19 Claims, 9 Drawing Sheets

GOLF BALL DIMPLE PATTERNS WITH MULTIPLE PHYLLOTACTIC ELEMENTS

FIELD OF THE INVENTION

The present invention is directed to golf balls. More particularly, the present invention is directed to a novel dimple arrangement method. Still more particularly, the present invention is directed to a novel method of arranging dimples in multiple polygonal areas on the surface of the ball, with at least some of the polygons having patterns based on phyllotaxis.

BACKGROUND OF THE INVENTION

Dimples are used on golf balls to control and improve the flight of the golf ball. The United States Golf Association (U.S.G.A.) requires that golf balls have aerodynamic symmetry. Aerodynamic symmetry allows the ball to fly with little variation no matter how the golf ball is placed on the tee or ground. Preferably, dimples cover the maximum surface area of the golf ball without detrimentally affecting the aerodynamic symmetry of the golf ball.

Most successful dimple patterns are based in general on three of the five existing Platonic Solids: Icosahedron, Dodecahedron or Octahedron. Because the number of symmetric solid body systems is limited, it can be difficult to devise new symmetric patterns.

There are numerous prior art golf balls with different types of dimples or surface textures. The surface textures or dimples of these balls and the patterns in which they are arranged are usually defined by Euclidean geometry.

For example, U.S. Pat. No. 4,960,283 to Gobush discloses a golf ball with multiple types of dimples having dimensions defined by Euclidean geometry. The perimeters of the dimples disclosed in this reference are defined by Euclidean geometric shapes including circles, equilateral triangles, isosceles triangles, and scalene triangles. The surfaces of the dimples are also Euclidean geometric shapes such as partial spheres.

U.S. Pat. No. 5,842,937 to Dalton et al. discloses a golf ball having a surface texture defined by fractal geometry and golf balls having indents whose orientation is defined by fractal geometry. The indents are of varying depths and may be bordered by other indents or smooth portions of the golf ball surface. The surface textures are defined by a variety of fractals including two-dimensional or three-dimensional fractal shapes and objects in complete or partial forms.

As discussed in Mandelbrot's treatise *The Fractal Geometry of Nature*, many forms in nature are so irregular and fragmented that Euclidean geometry is not adequate to represent them. In his treatise, Mandelbrot identified a family of shapes, which described the irregular and fragmented shapes in nature, and called them fractals. A fractal is defined by its topological dimension DT and its Hausdorf dimension D. DT is always an integer, D need not be an integer, and D is always equal to or greater than DT (See p. 15 of Mandelbrot's The Fractal Geometry of Nature). Fractals may be represented by two-dimensional shapes and three-dimensional objects. In addition, fractals possess self-similarity in that they have the same shapes or structures on both small and large scales. U.S. Pat. No. 5,842,937 uses fractal geometry to define the surface texture of golf balls.

Phyllotaxis is a manner of generating symmetrical patterns or arrangements. Phyllotaxis is defined as the study of the symmetrical pattern and arrangement of leaves, branches, seeds, and petals of plants. See Phyllotaxis A Systemic Study in Plant Morphogenesis by Peter V. Jean, p. 11-12. These symmetric, spiral-shaped patterns are known as phyllotactic patterns. Id. at 11. Several species of plants such as the seeds of sunflowers, pine cones, and raspberries exhibit this type of pattern. Id. at 14-16.

Some phyllotactic patterns have multiple spirals on the surface of an object called parastichies. The spirals have their origin at the center of the surface and travel outward, other spirals originate to fill in the gaps left by the inner spirals. Frequently, the spiral-patterned arrangements can be viewed as radiating outward in both the clockwise and counterclockwise directions. These types of patterns are said to have visibly opposed parastichy pairs denoted by (m, n) where the number of spirals at a distance from the center of the object radiating in the clockwise direction is m and the number of spirals radiating in the counterclockwise direction is n. The angle between two consecutive spirals at their center C is called the divergence angle d. Id. at 16-22.

The Fibonacci-type of integer sequences, where every term is a sum of the previous other two terms, appear in several phyllotactic patterns that occur in nature. The parastichy pairs, both m and n, of a pattern increase in number from the center outward by a Fibonacci-type series. Also, the divergence angle d of the pattern can be calculated from the series. Id.

When modeling a phyllotactic pattern such as with sunflower seeds, consideration for the size, placement and orientation of the seeds must be made. Various theories have been proposed to model a wide variety of plants. These theories can be used to create new dimple patterns for golf balls using the science of phyllotaxis.

There is minimal prior art disclosing the use of the science of phyllotaxis for improving the aerodynamic characteristics for golf balls. U.S. Pat. No. 5,060,953 discloses dimple patterns having dimples extending along intersecting clockwise and counterclockwise arcs extending from each pole to the dimple-free equator. Although phyllotaxis is never cited, the result is something similar. Nevertheless, the disclosed patterns are specifically limited to arcs running from each pole to the equator, establishing a single axis of symmetry. There is no teaching of multiple axes of symmetry with the inherent advantages.

U.S. Pat. Nos. 6,533,684, 6,338,684 and 6,682,441, all owned by the Assignee of the preset invention, are directed to phyllotaxis based dimple patterns that have only two origins (one at each pole) with spirals extending to the equator. Again, this limits them to a single axis of symmetry which is inferior to the multiple axes. These patents, while making an offhand reference to polygonal areas each filled with phyllotactic arrangements of dimples, do not divulge any details.

U.S. Pat. No. 6,699,143 elaborates on the concept of polygonal areas filled with phyllotactic dimple arrangements. However, no specific disclosures or examples are given. Furthermore, it specifically prohibits the overlapping of dimples within the areas, between areas, or over the equator. In contrast, all of the patterns disclosed in the present invention and virtually any pattern developed using its techniques will produce many dimples that overlap the equator. Furthermore, the present invention encourages overlapping dimples both within the areas and between the areas to improve the visual appeal and to enhance performance for lower swing speed golfers.

SUMMARY OF THE INVENTION

The present invention uses phyllotactic patterns to arrange and pack multiple strings of dimples within individual polygonal faces of a golf ball surface formed by a polyhedron based dimple pattern. Each polygonal face area has its own phyllotactic origination point yielding multiple axes of symmetry. The origination point is at the center of the polygonal face and most or substantially all of the dimples are positioned according to phyllotactic patterns.

The dimple patterns may have at least two different dimple types distinguished by size, shape, or other parameters and should include between 250 and 450 dimples. While the shape of the dimples may be varied, for the present invention the dimples are preferably rounded and may have substantially the same diameter and depth or for some embodiments the diameter and depth of the dimples is varied.

An embodiment of the invention comprises a dodecahedron based dimple pattern having multiple pentagon shaped surface areas, each pentagon having a common dimple at the center and five spirally shaped arms of equally sized dimples radiating outward.

Another embodiment of the invention comprises a truncated cube dimple pattern consisting of octagon shaped dimple areas and triangular shaped dimple areas, wherein only the octagon shaped areas have dimples in a phyllotactic arrangement.

For low swing speed applications the dimples may be arranged to overlap each other along the phyllotactically arranged strings.

BRIEF DESCRIPTION OF THE DRAWINGS

Reference is next made to a brief description of the drawings, which are intended to illustrate a first embodiment and a number of alternative embodiments of the golf ball according to the present invention.

DETAILED DESCRIPTION OF THE INVENTION

The present invention presents a new family of dimple patterns, their layouts and features, and the techniques used to generate them. The overall pattern structures are based on polyhedrons as is well known in the art, but within the individual polygonal faces, the dimples are arranged in phyllotactic patterns. The faces have their own phyllotactic origination points, yielding multiple axes of symmetry in the overall pattern which in turn leads to improved accuracy and symmetry in the flight performance of the ball. Furthermore, it provides a novel and attractive visual appearance. Previously disclosed phyllotactic dimple patterns utilized only two origination points (one at each pole), which produced symmetry issues due to uneven distribution of land area and dimple sizes. See U.S. Pat. Nos. 6,338,684, 6,533,684, 6,682,441 and 6,699,143 for detailed discussions of phyllotaxis and how it can be use to lay out dimple patterns. In short, it relates to spiral shaped arrangements found in nature, such as the arrangement of seeds in a sunflower head. Dimples can be laid out in spiral patterns on a golf ball, mimicking similar patterns found in nature.

The process of the present invention divides up the surface of the ball into spherical polygonal areas that correspond to the faces of a polyhedron. This is the same procedure that is used for conventional dimple patterns, and is well known in the art. Most commonly, dimple patterns are based on regular icosahedrons, regular dodecahedrons or regular octahedrons. Respectively, these polyhedrons result in dimple patterns having 20 regular triangular areas, 12 regular pentagonal areas, or eight regular triangular areas. Dimple patterns are also commonly based on triangular, pentagonal, or hexagonal dipyramids, resulting in six, 10, or 12 isosceles triangular areas, respectively. Also, semi-regular polyhedrons are used, such as the cuboctahedron which yields six square areas and eight regular triangular areas and the truncated cube which provides six regular octagonal areas and six regular triangular areas. Upon the ball surface being divided, a phyllotactic arrangement of dimples is devised to fill one of the spherical polygonal areas. Typically, this arrangement will comprise a series of spiral shaped strings of dimples starting from a common origin point at the center of the area, and extending outward to the perimeter of the area. This arrangement is repeated in each of the other similar areas, making up a complete pattern. If the ball surface includes other types of spherical polygonal areas, they may be filled in the same manner.

Figure 1:
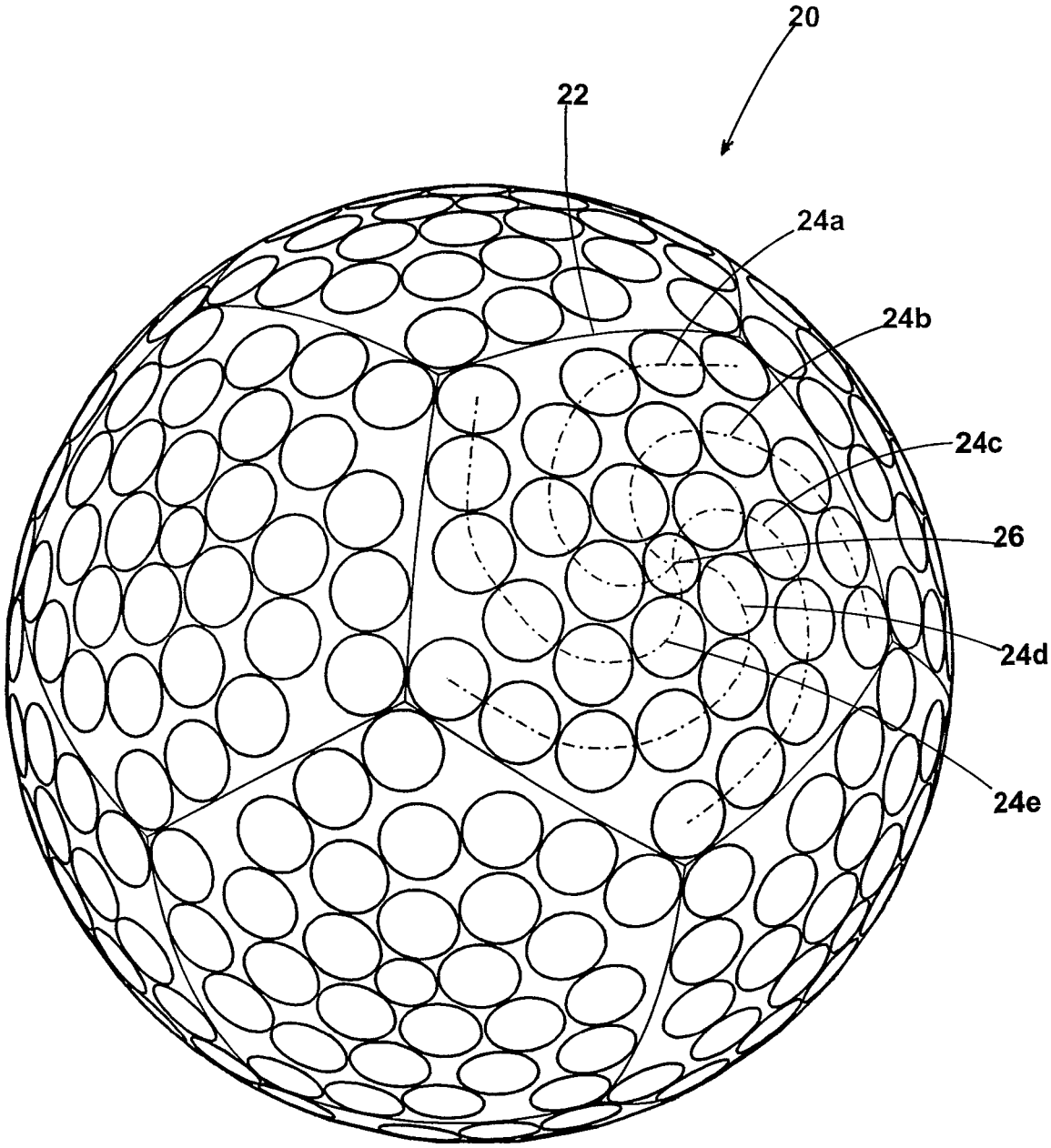
FIG. 1 is a golf ball of the invention having a dodecahedron based dimple pattern comprising pentagon shaped areas, each area filled with strings of dimples arranged in a phyllotactic pattern.
Figure 2:
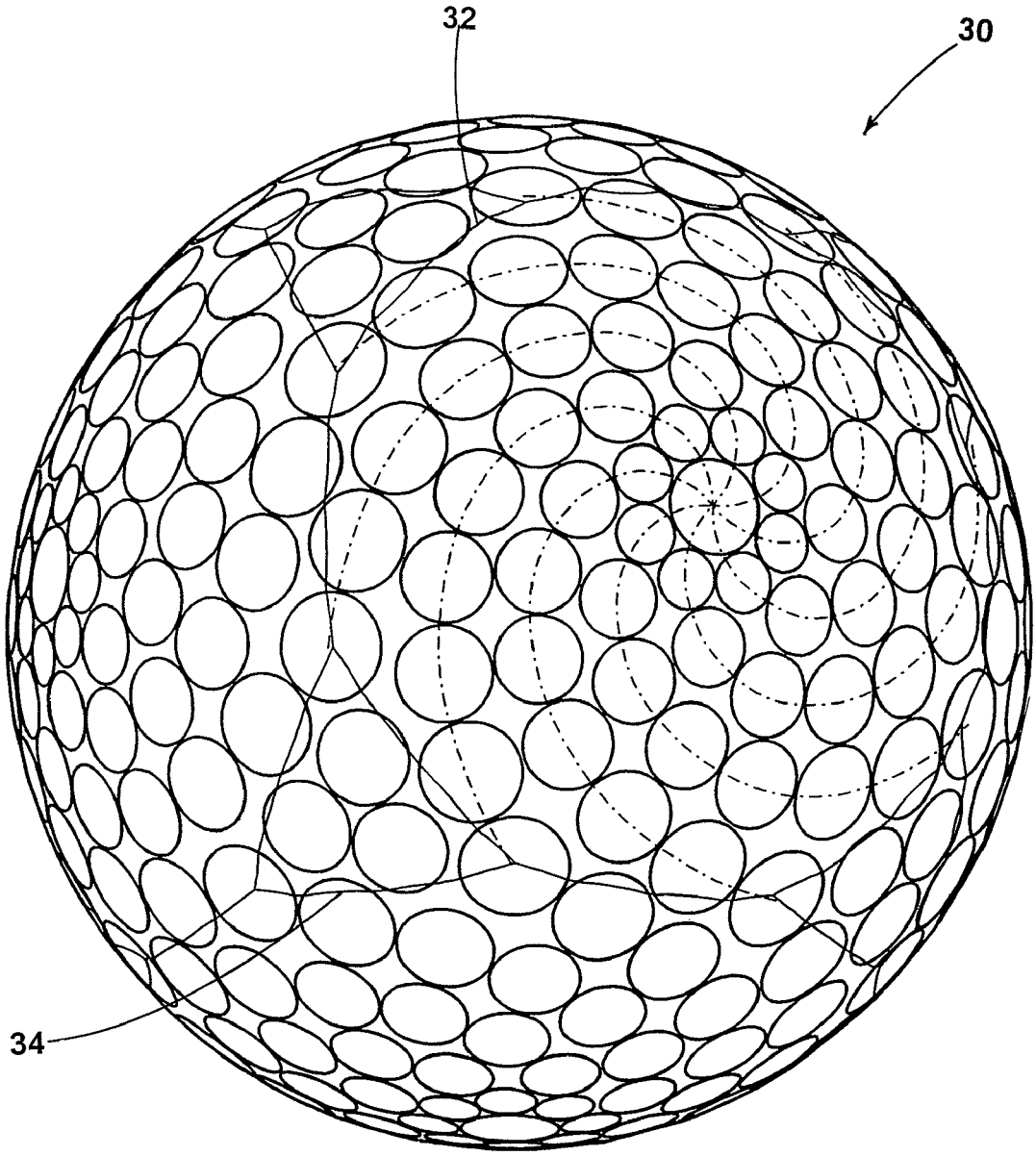
FIG. 2 is an embodiment of the invention having a truncated cube pattern of dimples.

FIG. 1 represents an embodiment of the invention wherein a golf ball 20 has a dodecahedron based dimple pattern, with each pentagon 22 filled with five spiral shaped arms 24*a*, 24*b*, 24*c*, 24*d*, and 24*e*, each having six equally sized dimples plus a small common center dimple 26. If a semi-regular polyhedron is used as the basis, there will be differently shaped areas (for example, squares and triangles in a cuboctahedron or octagons and triangles in a truncated cube). In the present invention, an arrangement is devised for each type of area and that arrangement is repeated in each similar area. It is not a requirement that all the arrangements be phyllotactic. For example, on a golf ball 30 having a truncated cube pattern, as shown in FIG. 2, the octagons 32 have phyllotactic arrangements while the triangles 34 do not. It is preferred, but not required, that areas sharing a common shape also share a common arrangement of dimples. The spirals may turn in a clockwise direction (from the center outward) as in FIG. 1, or in a counterclockwise direction as in FIG. 2. If all the spirals on a ball turn in the same direction as the golf ball 40 shown in FIG. 3, then in many cases the arms will interconnect between neighboring areas, producing long S-shaped strings of dimples 42. If spirals turning in different directions are used on the same ball as on golf ball 50 shown on FIG. 4, then some arms may connect to form S shapes, while others may connect to form cusped shapes.

Figure 4:
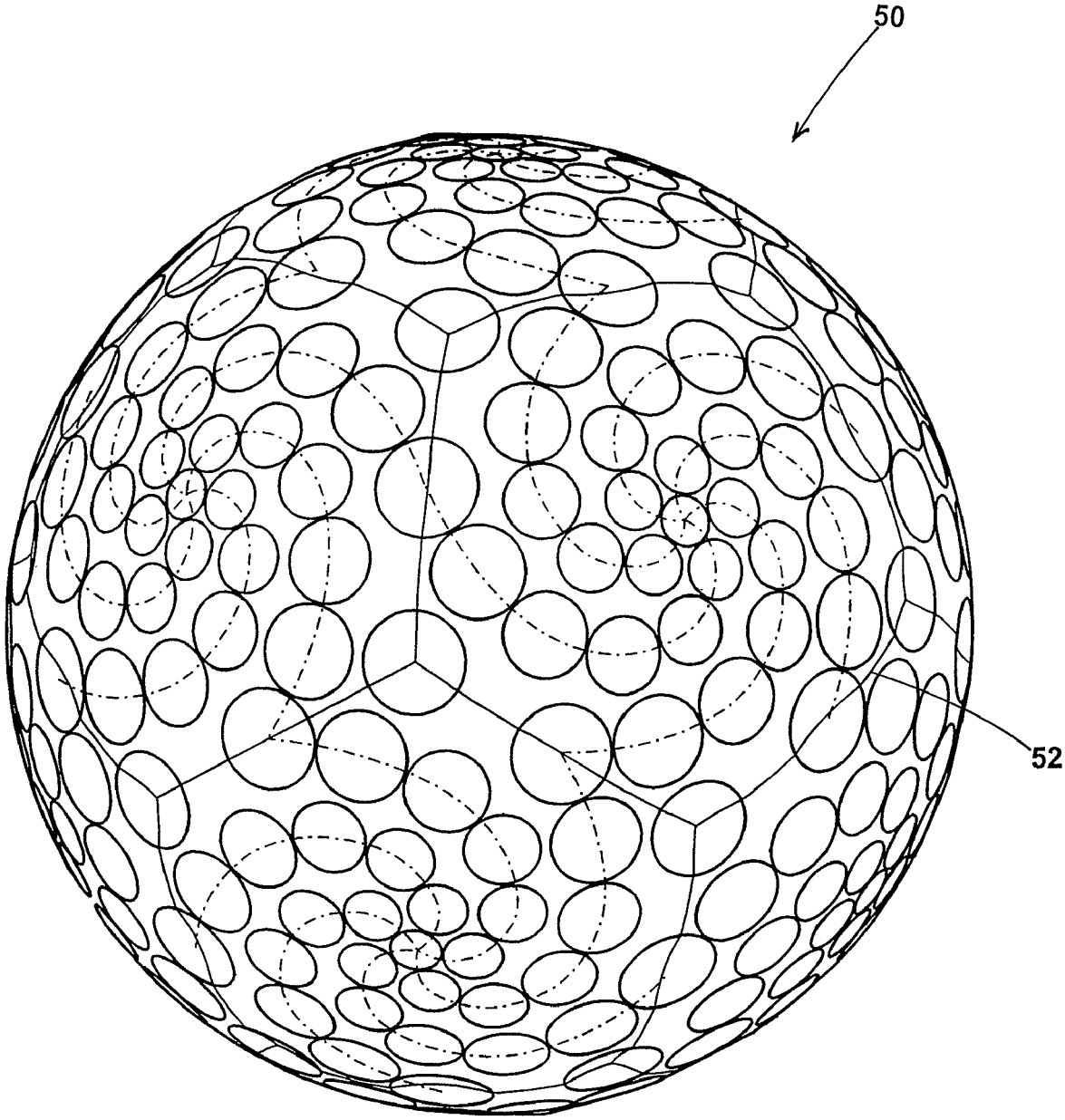
FIG. 4 is an embodiment of the invention having dimple strings within some polygonal faces turning in the opposite direction to dimple strings in other polygonal faces.
Figure 5:
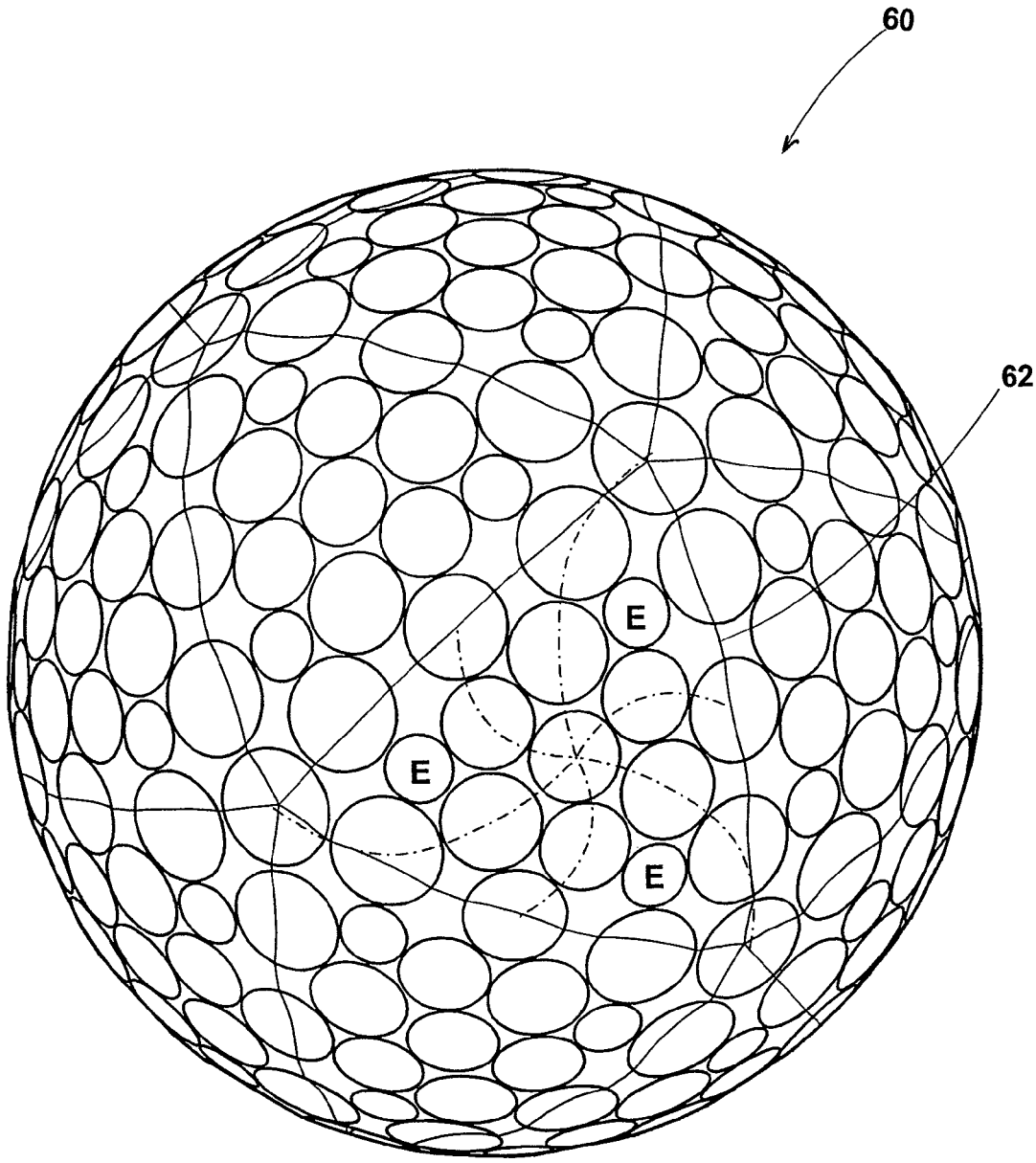
FIG. 5 is an embodiment of the invention wherein each triangular area has six strings of dimples arranged in a phyllotactic pattern.

While any suitable number of arms may be used to fill a polygonal area, it is preferred that the number of arms is equal to either the number of sides on the polygon or twice the number of sides on the polygon. For polygons having five or more sides, the former is preferred, while for polygons having four or fewer sides, the latter is preferred. FIG. 4 shows pentagonal areas 52 filled with five arms, while FIG. 5 shows a golf ball 60 having triangular areas 62 filled with six arms.

Figure 6:
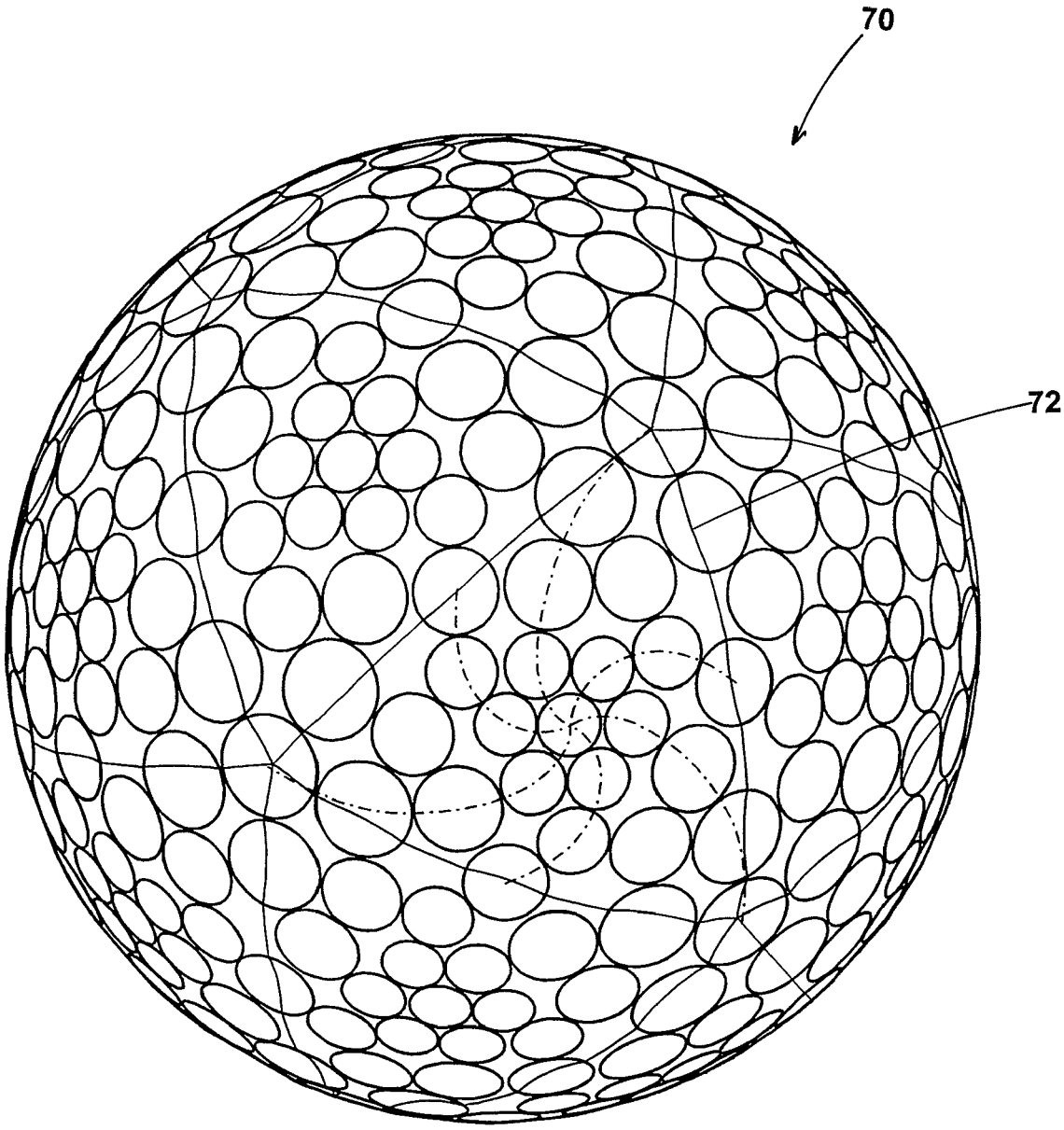
FIG. 6 is an embodiment of the invention wherein each triangular area has alternating types of dimple strings.

The arms used to fill a given polygon may be all the same, or there may be different types. For example, FIG. 6 shows a golf ball 70 having an icosahedron based pattern in which each triangle 72 is filled with six arms of two alternating types. One type has four dimples starting with the common dimple at the origin and ending with a dimple centered at the midpoint of the triangle side. The other type has five dimples starting with the common dimple at the origin and ending with a dimple centered on the triangle vertex. As is commonly found in natural phyllotactic patterns, it is also possible that some of the arms begin at a point some distance away from the origin and thus do not utilize the common dimple.

Figure 7:
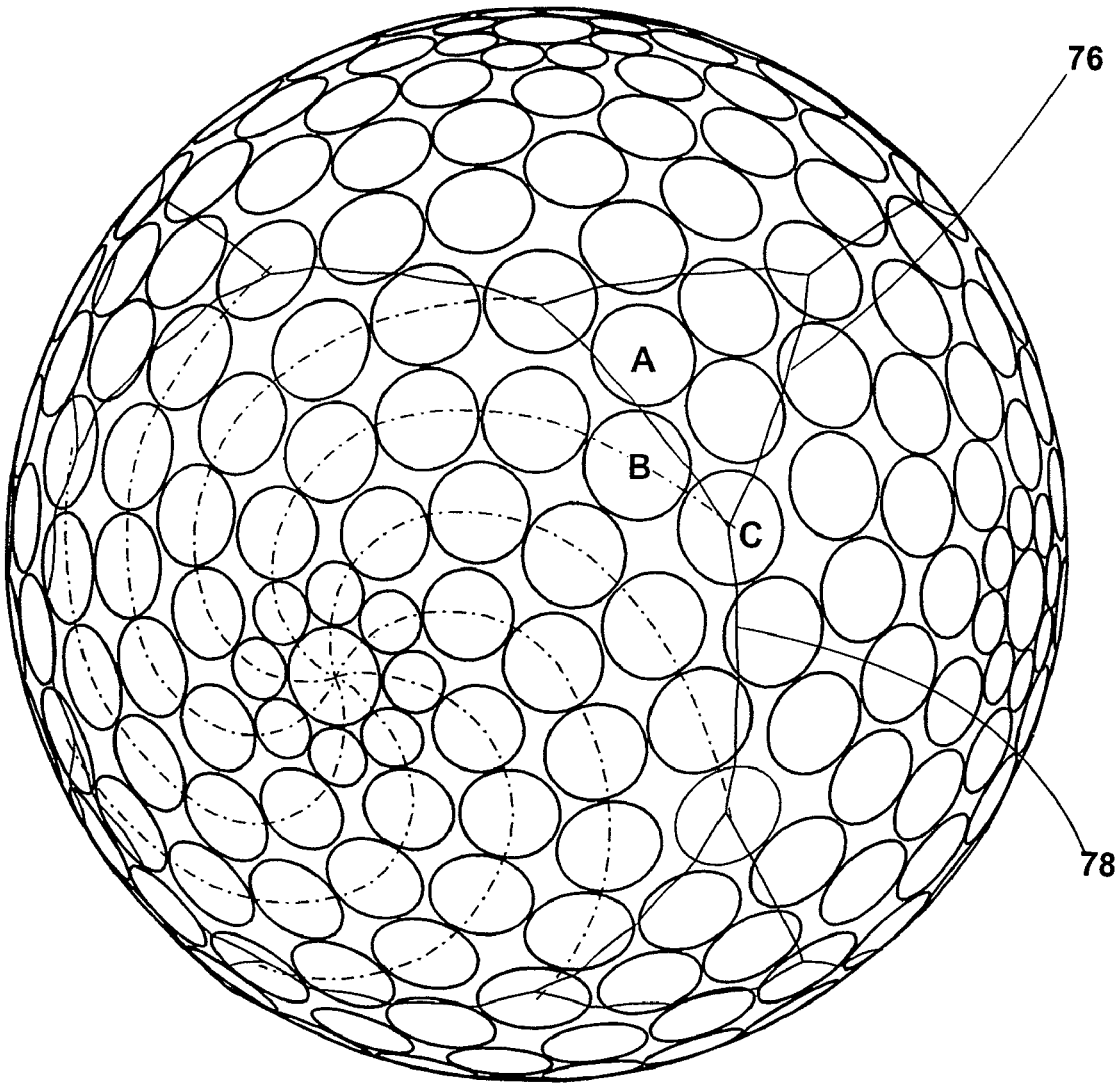
FIGS. 7 and 8 illustrate a golf ball having a truncated cube based pattern of dimples and how the dimples are assigned to each polygonal face.
Figure 8:
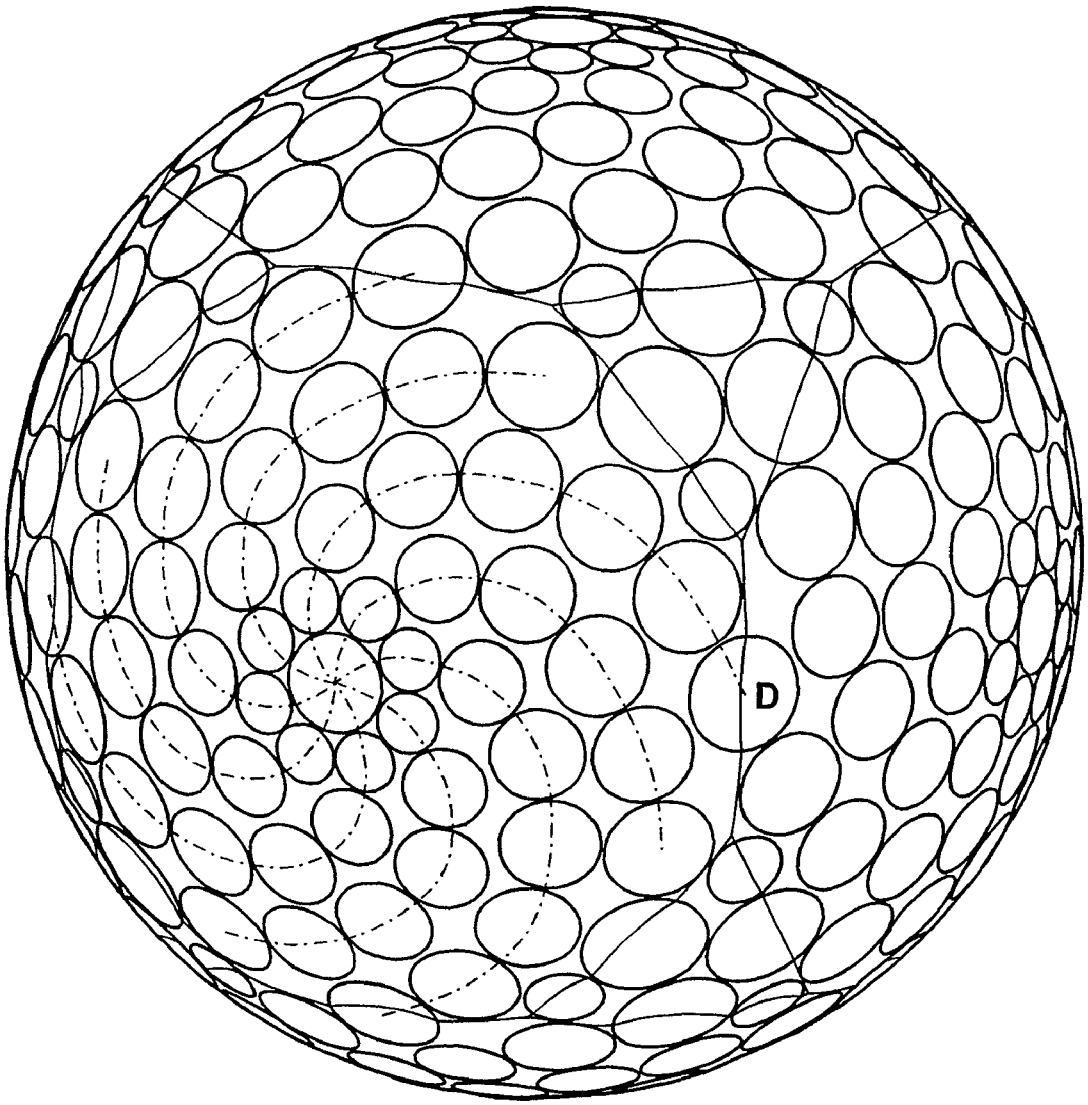

It will be appreciated that in some situations, dimples may intersect the sides of the polygons, producing some degree of ambiguity as to which polygon "owns" it. The present invention considers a dimple to be "in" the polygon that contains its geometric center point. For a dimple whose center lies precisely on the polygon side or vertex, it is considered to be shared equally among those polygons that share that side or vertex. An embodiment shown in FIG. 7 displays a truncated cube based pattern that includes triangular areas 76 and octagonal areas 78. Dimple A crosses a boundary between a triangle and an octagon, but since its center lies within the triangle, it belongs to the triangle. Dimple B also crosses such a boundary, but since its center lies within the octagon, it belongs to the octagon. However, dimple C is centered on a vertex, so it is shared equally (in an ownership sense) among the triangle and the two octagons that share the vertex. In FIG. 8, a truncated cube based pattern is shown in which a dimple D is centered on a boundary between two octagons, so its ownership is shared equally between them.

It is preferred that the polygonal areas be filled entirely by spiral shaped arms or strings of dimples. In some situations, large gaps will be left between the arms. This may enhance the visual impact of the unusual spiral patterns, but from an aerodynamic standpoint it is preferable to fill these gaps if they are large enough to accommodate reasonably sized dimples. The dimple pattern shown on FIG. 5 would include some very large gaps if they were not filled by dimples E.

Figure 3:
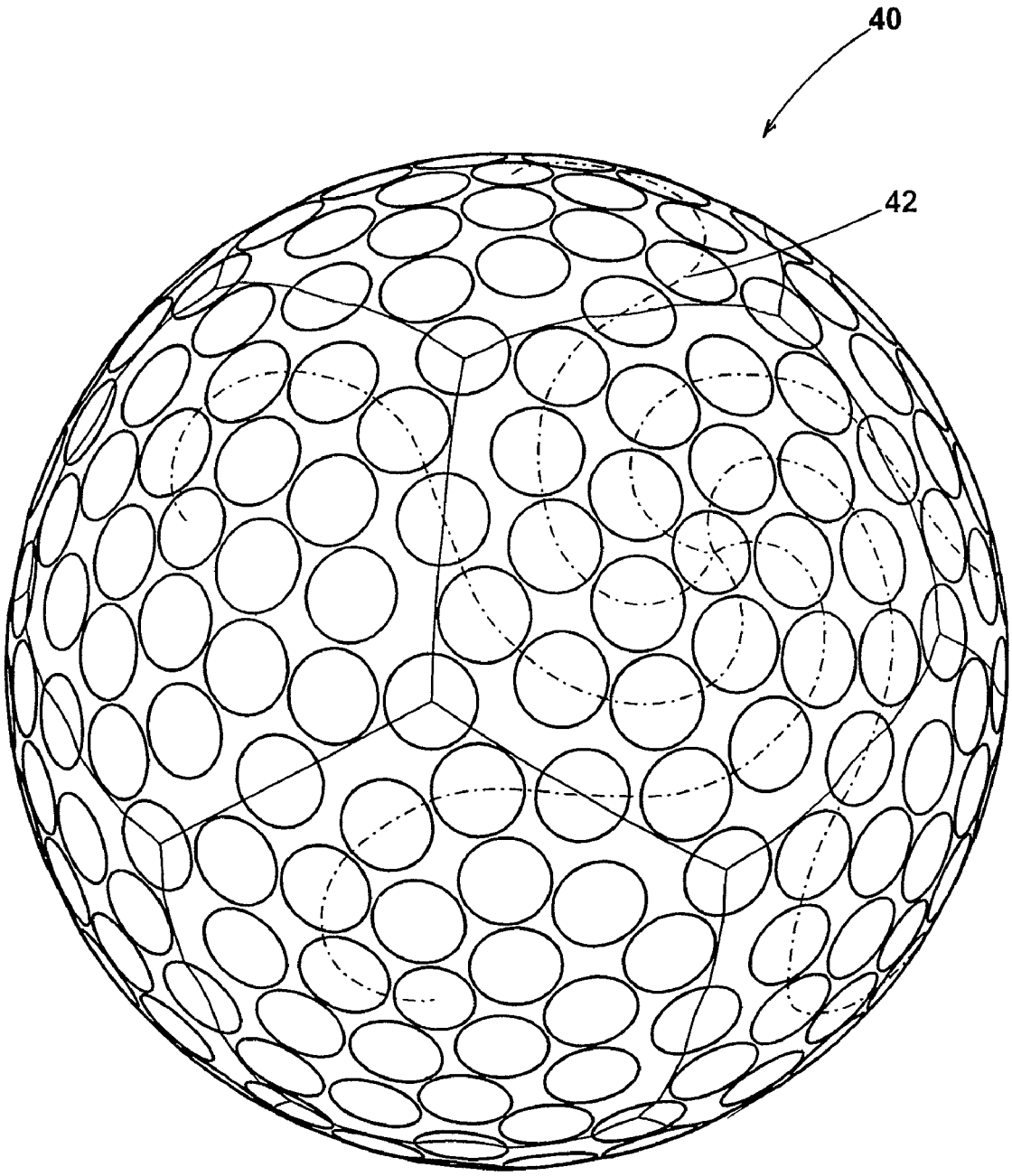
FIG. 3 is an embodiment of the invention having all the dimple strings turning in the same direction.

While it is possible to produce patterns within the present invention that are primarily composed of a single dimple size as shown in FIGS. 1 and 3, it is preferable from an aerodynamic standpoint to incorporate multiple dimple sizes as in the other figures. The present invention encourages a diversity of dimple sizes, because it is generally easier to accomplish a high degree of dimple coverage if smaller diameters are used near the origin, transitioning to larger diameters toward the outside.

Figure 9:
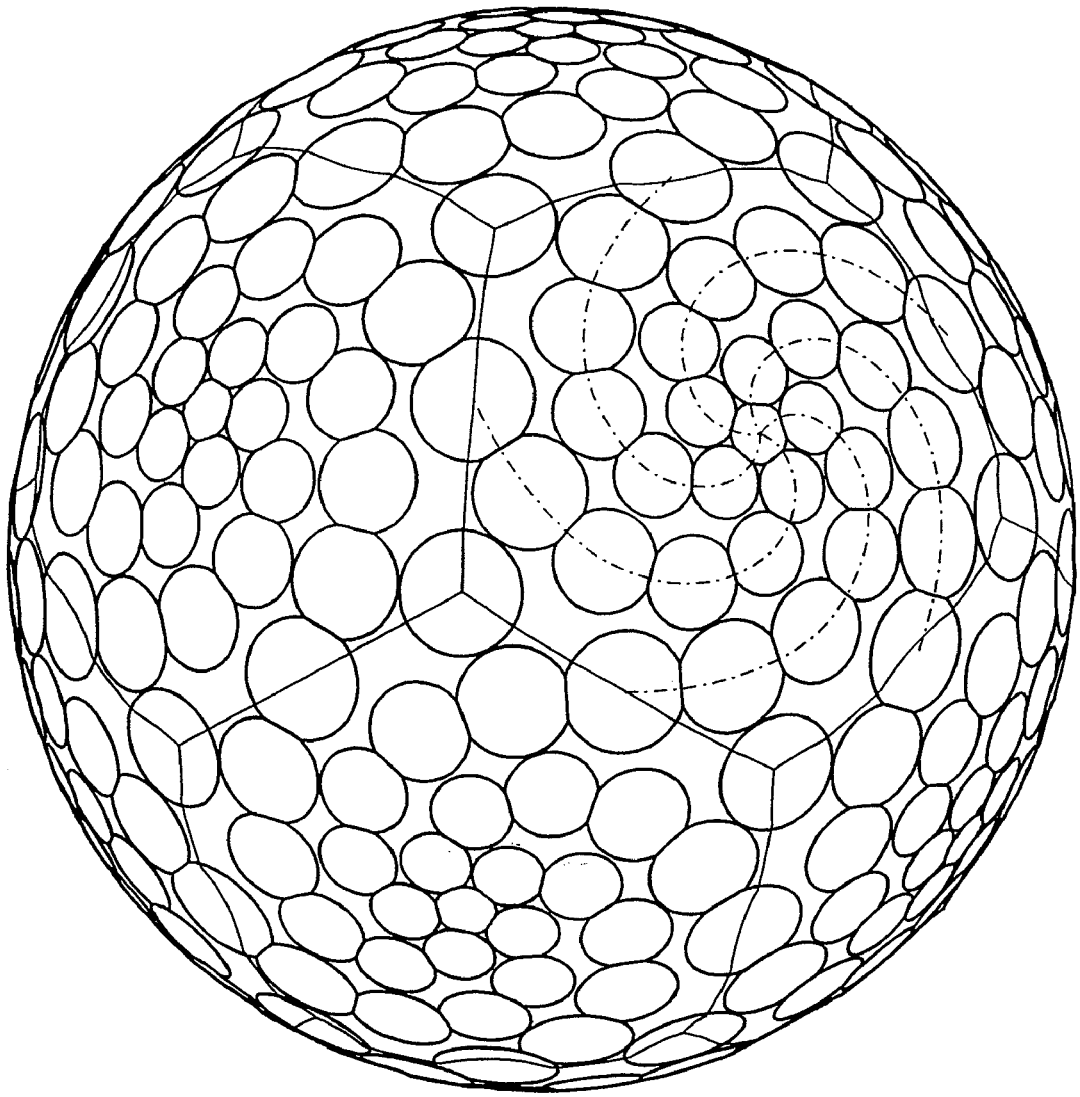
FIG. 9 is an illustration of overlapping dimples that are arranged in a phyllotactic pattern.

A significant feature of the present invention is the unusual appearance of the spiral shaped strings of dimples, especially when they link up between polygons to produce interconnecting S shaped strings as in FIGS. 3, 4, 5, 6, and 8. In order to enhance the visual impact, it is advantageous to size and position the dimples so that they overlap somewhat along the strings, but not between the strings, as shown in FIG. 9. The overlapping creates visual links among the dimples along a string, unifying those dimples into a single visual element. Additionally, it is believed that overlapping dimples can provide extra flight distance for players with lower swing speeds. For this purpose, it may be beneficial to overlap the dimples, both along the strings and between strings.

Phyllotaxis involves the study of symmetrical patterns or arrangements. This is a naturally occurring phenomenon. Usually the patterns have arcs, spirals or whorls. Some phyllotactic patterns have multiple spirals or arcs on the surface of an object called parastichies. As shown in FIG. 1, the spirals have their origin at the center 26 of the surface and travel outward, while other spirals may originate away from the center to fill in the gaps left by the inner spirals. See Jean's Phyllotaxis A Systemic Study in Plant Morphoegnesis at p. 17. Frequently, the spiral-patterned arrangements can be viewed as radiating outward in both the clockwise and counterclockwise direction.

Particular attention must be paid to the number of dimples so that the result is not too high or too low. Preferably, the pattern includes between about 250 to about 450 dimples, more preferably from between about 300 to about 400 dimples. Multiple dimple sizes can be used to affect the percentage of coverage and the number of dimples. The dimples or indents can be of a variety of shapes, sizes and depths. For example, when view from above the indents can be generally rounded, such as circular, oval or egg-shaped. They can also be generally polygonal such as triangular, square, diamond-shaped, pentagonal or hexagonal. Other suitable shapes can be used as well. When viewed in cross-section, the shape may be circular arc, catenary, multi-radius, faceted, or any other suitable configuration. In sum, any type of dimple or protrusion (bramble) known to those skilled in the art could be used with the present invention.

In the present invention, this method of placing dimples is used to pack dimples on a portion of the surface of a golf ball. Preferably, the golf ball surface is divided into sections or portions corresponding to the faces of a polyhedron, as is commonly practiced in the art, and each section or portion is packed with dimples or other textural elements according to the phyllotactic method described above. For example, this method of packing dimples can be used to generate the dimple pattern for the pentagon of a typical dodecahedron or the triangle of a typical icosahedron dimple pattern. Thus, this method of packing dimples can be used to create new types of dimple patterns based on existing underlying polyhedral geometries.

As shown in FIGS. 1 to 9, various dimple sizes can be used in the dimple patterns. To generate a dimple pattern with different sized dimples, more than one dimple size is defined and each size dimple is used when certain criteria are met. Preferably, computer modeling tools are used to assist in designing a phyllotactic dimple pattern.

While it is apparent that the illustrative embodiments of the invention herein disclosed fulfills the objectives stated above, it will be appreciated that numerous modifications and other embodiments may be devised by those skilled in the art. For example, a phyllotactic pattern can be used to generate dimples on a part of a golf ball or creating dimple patterns using phyllotaxis with the geometry of the dimples generated using fractal geometry. Therefore, it will be understood that the appended claims are intended to cover all such modifications and embodiments which come within the spirit and scope of the present invention.

What is claimed:

1. A golf ball, comprising:

an outer surface having a plurality of spherical polygonal regions;

multiple strings of dimples arranged in phyllotactic patterns within each polygonal region;

each polygonal region having its own phyllotactic origination point; and the polygonal regions comprising a dodecahedron based dimple pattern and the polygonal regions being of a pentagon shape, each pentagon having a common dimple and five spirally shaped arms of dimples, wherein the overall dimple pattern has more than one axis of symmetry.

2. The golf ball of claim 1, wherein the origination point is at the geometric center of the polygonal region.

3. The golf ball of claim 1, wherein substantially all of the dimples are defined by the phyllotactic patterns.

4. The golf ball of claim 3, further comprising dimples of at least two different sizes.

5. The golf ball of claim 3, wherein the golf ball includes between about 250 to about 450 dimples.

6. The golf ball of claim 5, wherein the golf ball includes between about 300 to about 400 dimples.

7. The golf ball of claim 3, wherein the dimples include generally rounded dimples.

8. The golf ball of claim 7, wherein each generally rounded dimple has substantially the same width and depth.

9. The golf ball of claim 7 wherein the generally rounded dimples have a plurality of widths and depths.

10. The golf ball of claim 1, wherein dimples overlap each other along the phyllotactically arranged strings.

11. The golf ball of claim 1, wherein each polygonal region comprises alternating types of phyllotactically arranged dimple strings.

12. A golf ball, comprising:

an outer surface having a plurality of spherical polygonal regions;

multiple strings of dimples arranged in phyllotactic patterns within each polygonal region;

each polygonal region having its own phyllotactic origination point; and each polygonal regions comprising a truncated cube dimple pattern consisting of octagon shaped regions and triangle shaped regions, wherein only the octagon shaped regions have dimples in a phyllotactic arrangement, wherein the overall dimple pattern has more than one axis of symmetry.

13. The golf ball of claim 12, wherein the origination point is at the geometric center of the polygonal region.

14. The golf ball of claim 12, further comprising dimples of at least two different sizes.

15. The golf ball of claim 12, wherein the golf ball includes between about 250 to about 450 dimples.

16. The golf ball of claim 15, wherein the golf ball includes between about 300 to about 400 dimples.

17. The golf ball of claim 12, wherein the dimples include generally rounded dimples.

18. The golf ball of claim 17, wherein each generally rounded dimple has substantially the same width and depth.

19. The golf ball of claim 17 wherein the generally rounded dimples have a plurality of widths and depths.

* * * * *